US007005105B2

(12) United States Patent
Lee et al.

(10) Patent No.: US 7,005,105 B2
(45) Date of Patent: Feb. 28, 2006

(54) FE-CR-AL ALLOYS FOR ELECTRIC RESISTANCE WIRES

(75) Inventors: Hee Woong Lee, Changwon-si (KR); Su Dong Park, Daegu-si (KR)

(73) Assignee: Korea Electrotechnology Research Institute, Kyungsangnam-do (KR)

( * ) Notice: Subject to any disclaimer, the term of this patent is extended or adjusted under 35 U.S.C. 154(b) by 0 days.

(21) Appl. No.: 10/029,200

(22) Filed: Dec. 28, 2001

(65) Prior Publication Data

US 2002/0122739 A1 Sep. 5, 2002

(30) Foreign Application Priority Data

Dec. 28, 2000 (KR) ..... 2000-84606

(51) Int. Cl.
*C22C 38/16* (2006.01)

(52) U.S. Cl. ..... 420/62; 420/40; 148/325

(58) Field of Classification Search ..... 420/40, 420/62; 148/325

See application file for complete search history.

(56) References Cited

U.S. PATENT DOCUMENTS 6,296,953 B1 * 10/2001 Linden et al. ..... 428/681

FOREIGN PATENT DOCUMENTS

| | | | |
|---|---|---|---|
| CN | 1122841 | * | 5/1996 |
| GB | 1299390 | * | 12/1972 |
| JP | 49115927 | * | 11/1974 |
| JP | 02118053 | * | 5/1990 |
| JP | 04083820 | * | 3/1992 |
| JP | 04350148 | * | 12/1992 |
| JP | 05098401 | * | 4/1993 |
| JP | 06330246 | * | 11/1994 |
| JP | 09263906 | * | 10/1997 |
| SE | 508595 | * | 10/1998 |
| SE | 513989 | * | 12/2000 |

* cited by examiner

*Primary Examiner*—Sikyin Ip
(74) *Attorney, Agent, or Firm*—Rothwell, Figg, Ernst & Manbeck, P.C.

(57) ABSTRACT

The present invention relates to Fe—Cr—Ar type alloys with additions to improve workability thereof, strength, and heat resistance. The present Fe—Cr—Al alloy for electric resistance wires comprises a basic alloy added with only Be of below 0.01 wt % or with both Be and misch metal composed of rare earth elements wherein the basic alloy consists of a balance element of Fe, a Cr element of 12~30 wt %, an Al element of 3~14 wt %, a Zr element of 0.01~1.5 wt %, and a Ti element of 0.001~0.1 wt %. The present Fe—Cr—Al type alloys remarkably improve physical properties of Fe—Cr—Al ferritic alloys, especially, workability and mechanical properties, and heating characteristic.

11 Claims, 1 Drawing Sheet

FE-CR-AL ALLOYS FOR ELECTRIC RESISTANCE WIRES

BACKGROUND OF THE INVENTION

1. Field of the Invention

The present invention relates to Fe—Cr—Al type alloys used for electric resistance wires, more particularly, to Fe—Cr—Ar type alloys with additions to improve workability thereof.

2. Description of the Related Art

In a conventional manufacturing method for Fe—Cr type resistance wires, Cr for stabilizing ferrite is added more than 14 wt % to improve oxidation resistance at high temperature as well as to obtain high resistivity and low coefficient of thermal expansion, and then Al is added to the Fe—Cr to form $Al_2O_3$ thin-film layer to improve heat resistance and corrosion resistance.

Because Al element reduces fluidity and workability it is added by only about 5.0 wt %. In addition, Zr, Ti, Mn, Nb, or rare earth elements are also added to increase adherence between matrix and the oxide layer and to form stable compounds in the matrix at high temperature. Therefore, recrystallization at high temperature is suppressed, which will result in superior workability at high temperature and better heat resistance.

Be is also an important element which can improve workability. Conventionally, Be is added less than 0.001 wt % to strengthen intergranular structure of a steel and to make grain finer. According to the addition of Be, it is possible to fabricate Fe—Cr—Al type alloys for electric resistance wires with improved workability.

Fe—Cr—Al type alloys for electric resistance wires of the best quality developed and manufactured at present has the strength of 70 Kgf/mm$^2$ (for a 0.2 mm-diameter rod wire) and the highest operating temperature of 1400° C. Such Fe—Cr—Al type alloys for electric resistance wires, which are main material for high temperature electric furnaces, are used widely and variously in architecture and medical fields as well as in industrial fields such as material melting and heat treatments. The Fe—Cr—Al type alloys are also used as exhaust pipes of automobiles and structure materials applicable to special environment.

In these days, Ni—Cr type nichrome wires are mostly used as electric resistance wires in daily-life products whereas Fe—Cr—Al type ferritic alloys are used in industrial fields.

Ni—Cr type nichrome wires can not be used in industrial fields because they have relatively low operating temperature, about 1200° C., and, Fe—Cr—Al type ferritic alloys have restricted application fields despite the advantage of high operating temperature (above about 1400° C.) because of its poor workability.

SUMMARY OF THE INVENTION

It is an object of the present invention to provide Fe—Cr—Al type alloys for electric resistance wires being capable of improving strength, workability and heat resistance at the same time.

A Fe—Cr—Al alloy for electric resistance wire fabricated according to the present invention comprises a ferritic basic alloy added with only Be of below 0.01 wt % or with both Be and misch metal of below 0.1 wt % composed of rare earth elements wherein the ferrite alloy system consists of a balance element of Fe, a Cr element of 12~30 wt %, an Al element of 3~14 wt %, a Zr element of 0.01~1.5 wt %, and a Ti element of 0.0001~0.1 wt %.

The present invention may be embodied in other specific forms without departing from the sprit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

BRIEF DESCRIPTION OF THE DRAWINGS

The accompanying drawings, which are included to provide a further understanding of the present invention, illustrate the preferred embodiments of the invention, and together with the description, serve to explain the principles of the present invention, and wherein.

DETAILED DESCRIPTION OF THE PREFFERRED EMBODIMENT

Figure 1:
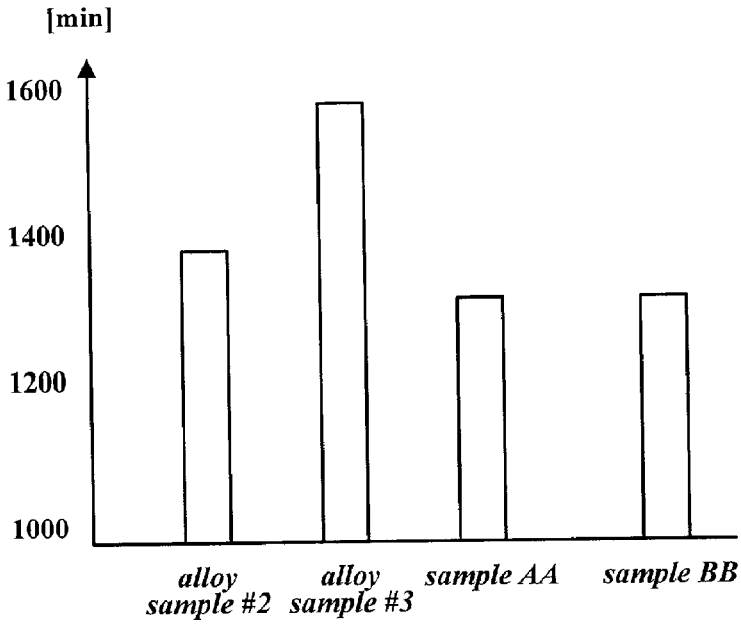
FIG. 1 is a lifetime graph for the present alloys and commonly in-use alloy samples.

In order that the invention may be fully understood, a preferred embodiment thereof will now be described with reference to the accompanying drawings.

In this embodiment, Be and misch metal, which has not been considered importantly in alloy designs until now, are used to acquire excellent heat resistance as well as superior hot and cold workability. Each alloying element in this embodiment acts as follows.

Cr is an element for stabilizing ferrite in a steel. A steel containing Cr more than 12 wt % is classified into ferritic stainless steel. A steel containing Cr less than 12 wt %, classified into austenitic Fe—Cr type steel, has better workability and strength at high temperature than a ferritic steel. However, austenitic Fe—Cr type steel has relatively high coefficient of thermal expansion and heat distortion at high temperature, thus, it is inadequate to be used for the manufacture of electric resistance wires.

On the contrary, ferritic Fe—Cr alloys have relatively superior oxidation resistance, high resistivity, and low coefficient of thermal expansion. However, the workability is lowered as much as Cr is added, therefore, proper Cr content is very important. In this embodiment, Cr is added within the range of 12 wt %~30 wt %.

Al forms an $Al_2O_3$ layer which improves heat resistance and corrosion resistance remarkably. For Fe—Cr alloys, very small Al content is able to form $Al_2O_3$ layer with ease and corrosion resistance is improved in proportion to Al addition as well.

However, because an $Al_2O_3$ layer has different coefficient of thermal expansion from a matrix, residual stress occurs at the boundary between the matrix and the oxidation layer. The residual stress brings about cracks readily in the manufacturing process, therefore, the increase of Al contents makes it more difficult to process the alloy. This means that proper Al content is very important. In this embodiment, Al is added less than 15 wt %, preferably within the range of 3~14 wt %.

Zr, which is a pro-oxidant element, stabilizes an oxidation layer by increasing adherence between oxide and the matrix, therefore, it also improves heat resistance and corrosion resistance greatly. In matrix of a base metal, the Zr element forms deposition particles of Zr—Al, Zr—Ti, or $Zr_xO_y$ or their compounds to increase recrystallization temperature and to suppress the growth of crystal grains. As a result, physical properties such as workability and strength at high temperature are improved. Considering this effect, Zr is added less than 1.5 wt %, preferably within the range of 0.01~1.5 wt % in this embodiment.

Ti, which is a ferrite stabilizing element, helps ferrite at high temperature and improves intergranular corrosion resistance and workability owing to $Ti_xC_y$ and $Ti_xN_y$ precipitates produced from the combination with C or N. However, the increase of Ti contents would deteriorate workability and oxidation resistance. Therefore, Ti is added less than 0.1 wt %, preferably within the range of 0.0001~0.1 wt % in this embodiment.

Be prevents the boundary segregation of other added elements in Al alloy systems as well as in Fe alloy systems to improve hot and cold workability. However, this element is so poisonous that it is difficult to increase Be content in manufacturing process. In addition, if Be content is increased Al—Be type precipitates are formed so that its effect is reduced. Therefore, Be content should be very small. Be element is added less than 0.1 wt %, preferably below 0.01 wt % in this embodiment.

The misch metal composed of rare earth elements improves surface stability of a coating layer and increases recrystallization temperature as well, thus, it is added to improve heat resistance and oxidation resistance. The misch metal constituting elements, namely, rare earth elements, e.g., Ce, La, Y, Nd, etc. accelerate selective oxidation of Cr and Al and develop a contiguous protective layer which enhances adherence between a coating layer and the matrix. Furthermore, because they suppress diffusion of Al with segregation to crystal grains, the depletion of Al is obstructed even in oxidizing atmosphere, as a result, the in-service lifetime of oxidation resistance is extended.

However, rare earth elements are somewhat expensive and are difficult to store and input. Therefore, the misch metal, which is composed of such rare earth elements and is relatively low in price, is used as addition in this embodiment to acquire the equivalent effects. If misch metal content to be added exceeds 0.1 wt %, the aforementioned effects, which are almost achieved in solid solution state, can not be expected because various compounds are formed. Thus, misch metal is added less than 0.1 wt % in this embodiment.

Table 1 shows comparative chemical compositions and physical properties between the present alloys and other conventional alloys including a touchstone basic alloy and commonly in-use alloys denoted as 'AA' and 'BB' which are products by major resistance wire manufacturing companies.

TABLE 1

Chemical and physical comparisons between the present alloys and conventional alloys

| | | Present Alloys | | | Other conventional alloys | | |
|---|---|---|---|---|---|---|---|
| Sample No. | | 1 | 2 | 3 | 4 | 5 | 6 |
| Chemical Composition (wt %) | Fe | Bal. | Bal. | Bal. | Bal. | AA | BB |
| | Cr | 22 | 22 | 22 | 22 | | |
| | Al | 6 | 6 | 6 | 6 | | |
| | Zr | 0.5 | 0.5 | 0.5 | 0.5 | | |
| | Ti | 0.03 | 0.03 | 0.03 | 0.03 | | |
| | Mm (Misch Metal) | 0.1 | | 0.1 | — | | |
| | Be | | 0.001 | 0.001 | — | | |
| Physical Properties*1 | tensile strength*1 (Kgf/mm$^2$) | 55.1 | 75.5 | 78.3 | 53.5 | 69.4 | 69.4 |
| | elongation*1 (%) | 15.0 | 25 | 27 | 10.5 | 19 | 19 |
| | Electric Resistance*1 (Ω) | 42 | 46.8 | 48.3 | 40.7 | 44.2 | 43 |
| | Remarks | For *1 Test Conditions Sample Diameter: 0.2 mm Sample Length: 50 mm | | | | | |

The products 'AA' and 'BB' in Table 1 have basic composition of Fe:Cr:Al:Zr:Ti=22~24:4~5:0.1~0.5:0.03:x wt %.

As shown in Table 1 obtained experimentally, the touchstone basic sample 4 not including misch metal, namely either of Be and Mm (Misch Metal) has tensile strength of 53.5 (Kgf/mm$^2$) and elongation of at most 10.5%. On the contrary, the sample 2 with only Be and the sample 3 with both Be and Mm has remarkably-improved tensile strength of over 75 (Kgf/mm$^2$) and elongation of over 25%.

Specially, the sample 3 with both Be and Mm has the best physical properties in the presented samples. However, the physical properties of the sample 1 with only Mm, which is 55.1 (Kgf/mm$^2$) intensile strength and 15% in elongation, is improved a little in comparison with the commonly in-use alloys.

Therefore, it has been verified that it is better to add only Be or both of Be and Mm. In addition, the physical properties acquired from the present alloys at same experimental conditions with other alloys are also superior to those of the commonly in-use alloys 'AA' and 'BB'. All the present alloys have higher resistance, which is directly related with joule heat of a resistance wire, than the alloys 'AA' and 'BB' as well as the touchstone alloy sample 4.

FIG. 1 is a lifetime graph for the best-property-revealed samples 2 and 3 and the commonly in-use samples 5 and 6. The graph of FIG. 1 has been obtained from a 0.7 mm-diameter wire at 1300° C. under Korean provision KSC2602-1982. As shown in the graph of FIG. 1, the present alloys has longer lifetime than the commonly in-use alloys.

Figure 2:
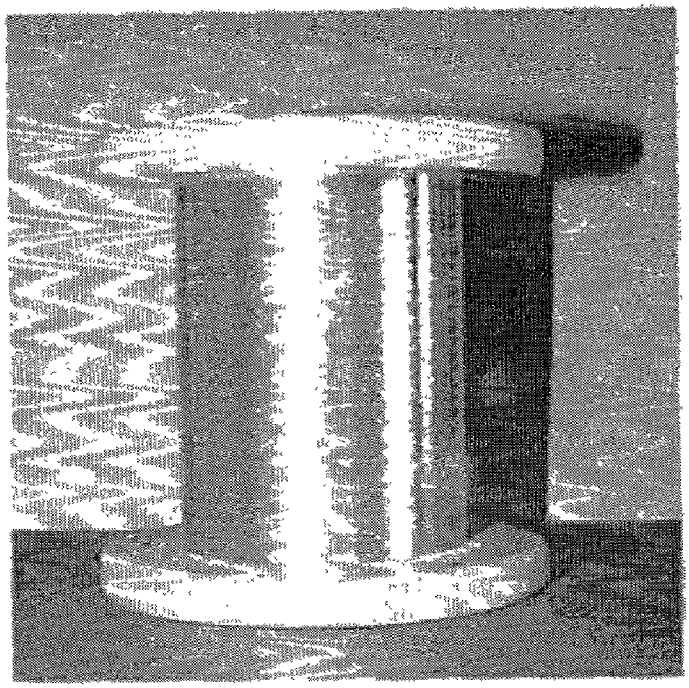
FIG. 2 shows 0.06 mm-diameter resistance wires manufactured successfully from the present alloys through cold drawing and heat treatments.

FIG. 2 shows wound 0.06 mm-diameter resistance wires manufactured successfully from the sample 3 through cold wire-drawing and heat treatments. The samples 2 and 3 presented in Table 1 can be thinned up to below 0.06 mm-diameter, however it was impossible to thin the touchstone alloy, the sample 4 and the sample 1 with only misch metal up to that diameter.

In conclusion, the present Fe—Cr—Al type alloys added with only Be or with both Be and misch metal give excellent heating characteristic as well as good workability, high strength, and high corrosion resistance.

According to the good workability, easier drawing is possible so that the manufacturing cost of related products can be reduced remarkably. In addition, replacement of rare earth elements with integrated materials thereof, namely, misch metal can reduce the manufacturing cost much more.

Because extremely thinning is possible owing to the present Fe—Cr—Al alloys, an electric heating appliance can be miniaturized and heating efficiency can be improved, thus, the present Fe—Cr—Al alloys can be widely used in small-sized heat conserving components and heat conserving medical equipment. Furthermore, the improved heat resistance and corrosion resistance can make products of the present Fe—Cr—Al alloy endurable for much longer time in exhaust pipes of automobiles and incinerators of the sulfurating atmosphere.

What is claimed is:

1. A Fe—Cr—Al—Zr—Ti—Be alloy, containing the elements Fe, Cr, Al, Zr, Ti and Be, said alloy comprising a balance element of Fe, a Cr element of 12–30 wt %, an Al element, present in an amount of about 3–15 wt %, a Zr element, wherein the Zr element is present in an amount of less than 1.5 wt %, a Ti element of 0.0001–0.15 wt %, and a Be element, present in an amount of about 0.001 wt %–0.1 wt %, and wherein said Fe—Cr—Al—Zr—Ti—Be alloy is usable for electric resistance wires.

2. The alloy of claim 1, further comprising at least one rare earth metal, wherein said at one rare earth metal is present in an amount of less than 0.1wt %.

3. The alloy of claim 2, wherein said rare earth metal is misch metal composed of rare earth elements.

4. The alloy of claim 3, wherein said rare earth is an element or mixture of at least two elements selected from the group consisting of Sc, La, Ce, Hf, Pd, Y, and Nd.

5. The alloy set forth in claim 1, wherein the Be element is present in an amount of less than 0.01 wt %.

6. The alloy of claim 1, wherein said alloy is used for an electrical resistance wire.

7. The alloy of claim 1, wherein the Al element is present in an amount of 3–14 wt %.

8. The alloy of claim 1, wherein the Zr element is present in an amount of 0.0 1–1.5 wt %.

9. The alloy of claim 2, wherein the content of said at least one rare earth metal is below 0.1 wt %.

10. The alloy of claim 1, wherein said alloy has a tensile strength of more than 75 $Kgf/mm^2$.

11. The alloy of claim 1, wherein said alloy has electric resistance of at least 46.8 Ohm, but not more than 48.3 Ohm.

* * * * *